US008910412B2

(12) United States Patent
Mikroulis

(10) Patent No.: US 8,910,412 B2
(45) Date of Patent: Dec. 16, 2014

(54) FIREARM RETICLE SYSTEM

(71) Applicant: Dimitri Mikroulis, Houston, TX (US)

(72) Inventor: Dimitri Mikroulis, Houston, TX (US)

( * ) Notice: Subject to any disclaimer, the term of this patent is extended or adjusted under 35 U.S.C. 154(b) by 0 days.

(21) Appl. No.: 14/024,525

(22) Filed: Sep. 11, 2013

(65) Prior Publication Data

US 2014/0068993 A1 Mar. 13, 2014

Related U.S. Application Data

(60) Provisional application No. 61/699,384, filed on Sep. 11, 2012.

(51) Int. Cl.

| | |
|---|---|
| ***F41G 3/06*** | (2006.01) |
| ***F41G 1/38*** | (2006.01) |
| ***F41G 3/08*** | (2006.01) |
| ***F41G 1/473*** | (2006.01) |

(52) U.S. Cl.

CPC .. *F41G 1/38* (2013.01); *F41G 3/06* (2013.01); *F41G 3/08* (2013.01); *F41G 1/473* (2013.01)

USPC ..... 42/122

(58) Field of Classification Search

CPC ..... F41G 1/38

USPC ..... 42/122, 130, 133, 141, 131, 111; D22/109; 89/41.17

See application file for complete search history.

(56) References Cited

U.S. PATENT DOCUMENTS

| | | | | |
|---|---|---|---|---|
| D306,173 | S * | 2/1990 | Reese | D16/130 |
| 6,032,374 | A * | 3/2000 | Sammut | 42/122 |
| 7,100,320 | B2 * | 9/2006 | Verdugo | 42/130 |
| 7,434,345 | B2 | 10/2008 | Verdugo | |
| 7,946,073 | B1 * | 5/2011 | Buck | 42/130 |
| 8,756,852 | B2 * | 6/2014 | Kramer et al. | 42/122 |
| 2006/0236586 | A1 * | 10/2006 | Zaderey | 42/133 |
| 2007/0097351 | A1 * | 5/2007 | York et al. | 356/5.02 |

OTHER PUBLICATIONS

Leupold & Stevens, Inc., Using the Tactical Reticle System, Usage Instructions Brochure, 2011.

Norden Performance, 1x6-24mm Combat Rifle Scope (CRS), Brochure.

* cited by examiner

*Primary Examiner* — Reginald Tillman, Jr.

(74) *Attorney, Agent, or Firm* — The Compton Law Firm, PC; Scott D. Compton

(57) ABSTRACT

The present application is directed to a firearm reticle system comprising (1) a reticle operationally configured to correlate one or more of bullet drop compensation, horizontal range estimation, wind lead information, and target travel speed lead information for a target and (2) a scale operationally configured to horizontally and vertically range the target.

18 Claims, 9 Drawing Sheets

FIREARM RETICLE SYSTEM

CROSS-REFERENCES TO RELATED APPLICATIONS

This application claims the benefit of provisional application No. 61/699,384 filed Sep. 11, 2012.

STATEMENT REGARDING FEDERALLY SPONSORED RESEARCH OR DEVELOPMENT

Not applicable.

FIELD OF THE APPLICATION

The present application relates to the field of reticles for telescopic sights and the like.

BACKGROUND

Firearm reticles are well known in the art. Reticle types range from the traditional "crosshairs" to dots, circles, other geometric shapes, and moveable cross lines or any combination of the above. Some reticles range estimate only in the width of a known target or only in the height of the known target, which may result in a false reading if the target, e.g., enemy combatant, is one that is not facing a shooter according to the requirements of the reticle or if the enemy combatant is running or if his/her legs or feet are not exposed. Other reticles may account for wind but do not range estimate and bullet drop compensate in one. In addition, with known reticles leading of a particular target is accomplished by aiming off the crosshairs of the reticle or by using mil dots of the reticle. In addition, known reticles can require various calculations that prolong or delay optimum target acquisition timing.

Overcoming the above shortcomings is desired.

SUMMARY

The present application is directed to a firearm reticle system comprising (1) a reticle operationally configured to correlate one or more of bullet drop compensation, horizontal range estimation, wind lead information, and target travel speed lead information for a target and (2) a scale operationally configured to horizontally and vertically range the target.

The present application is also directed to a firearm reticle system for acquisition of a target, the firearm reticle system having one or more pre-set parameters selected from the group consisting of bullet drop compensation information, wind lead information, target travel speed lead information, ranging information, and combinations thereof according to a particular package, the reticle system including a reticle having a ring like central aiming member wherein the uppermost and bottommost portions of the central aiming member are empty and a scale operationally configured to horizontally and vertically range the target.

The present application is also directed to a calculation free method of decreasing time on target for a user of a firearm comprising providing a firearm reticle system for use with a firearm of a particular package, the firearm reticle system having pre-set parameters selected from the group consisting of bullet drop compensation information, wind lead information, target travel speed lead information, ranging information, and combinations thereof, wherein the firearm reticle system includes (1) a reticle operationally configured to correlate bullet drop compensation with horizontal range estimation for a target and (2) a scale operationally configured to horizontally and vertically range the target; wherein the reticle includes one or more wind adjustment members and one or more leads operationally configured to compensate for a target moving at a particular average speed.

BRIEF DESCRIPTION

Figure 1:
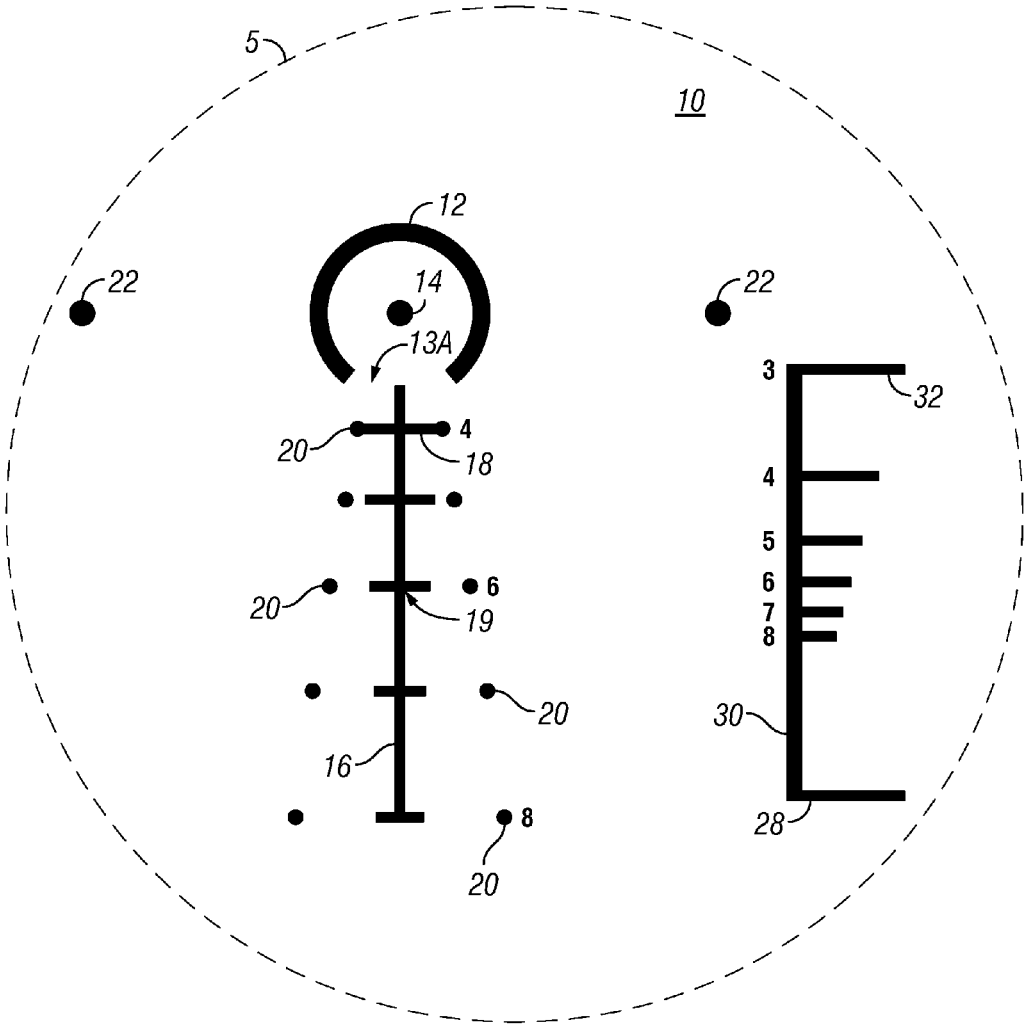
FIG. 1 is a plan view of an embodiment of the reticle system of the present application.

It has been discovered that a reticle system may be provided with one or more pre-calculated (or pre-set) parameters including, but not necessarily limited to bullet drop compensation information, wind lead information, target travel speed lead information, ranging information, and combinations thereof in a manner effective to minimize time on target, i.e., minimize target acquisition time. Heretofore, such a desirable achievement has not been considered possible, and accordingly, the reticle system and method of this application measure up to the dignity of patentability and therefore represents a patentable concept.

Many objects of this invention will appear from the following description and appended claims, reference being made to the accompanying drawings forming a part of this specification wherein like reference characters designate corresponding parts in the several views. It is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting. As used in this specification and the appended claims, the term "reticle" or "reticule" in relation to firearms refers to lines and/or other markings found on an eyepiece of a sighting device such as a telescopic sight. The phrase "enemy combatant" refers to a human being or target having the general size and shape of a human being as understood by persons of ordinary skill in the art of firearm target shooting. In other embodiments, "enemy combatant" may refer to predators and small game hunting applications. The "average center mass" of an enemy combatant suitably includes the width of the enemy combatant's torso or chest region when directly facing the user of the reticle system. The term "dot" is used to define an indicator of the location of generic aiming points on the reticle system. The term "dot" may employ any shape as desired and need not necessarily be provided in substantially circular form. Herein "mph" stands for miles per hour and "mps" refers to meters per second. Herein "km/h" stands for kilometers per hour. The phrase "time on target" refers to the time required for a firearm shooter to realize the aiming point of a given round ("target acquisition") to a particular target in real time.

The skilled artisan will appreciate that the conception upon which this disclosure is based may be utilized as a basis for other systems and methods for carrying out the several purposes of the present invention. It is important, therefore, that the claims be regarded as including such equivalent constructions insofar as such does not depart from the spirit and scope of the present invention.

In one aspect, the application provides a bullet drop and ranging reticle system for firearms including a primary reticle and a corresponding ranging scale operationally configured to vertically and/or horizontally range a predetermined sized target according to the height and/or width of the target. As such, the user of the reticle system can aim and fire upon a target without having to make any calculations regarding bullet drop compensation data, wind data, moving target leading data, ranging data, and combinations thereof.

In another aspect, the application provides a firearm reticle system effective to optimize or otherwise improve shooting accuracy by allowing a shooter to take into account factors including but not necessarily limited to the height and width of a target, bullet drop compensation, wind compensation and the traveling speed of a target relative to what are considered by the skilled artisan as the cardinal directions.

In another aspect, the reticle system may be provided using a main reticle and a separate but integrated corresponding ranging scale adjacent thereto, the reticle system being effective for horizontal and vertical ranging of a target, correlating bullet drop compensation and adjusting for wind and leading of a moving target in real time.

In another aspect, the application provides a firearm reticle system operationally configured to correlate bullet drop compensation with range estimation of a target including a target of a predetermined size and/or shape in windy conditions without having to make calculations to obtain information not already available via the reticle system configuration.

In another aspect, the application provides a firearm reticle system operationally configured for use with a particular caliber firearm and/or range of a particular target.

In another aspect, the application provides a firearm sighting system including a reticle operationally configured to provide aiming capabilities and a scale adjacent thereto to provide ranging of a desired target.

In another aspect, the application provides a firearm reticle system including a reticle operationally configured to range a moving target in real time using known parameters including, but not necessarily limited to the central mass of a target, the height of a target, the traveling speed of a target in motion and wind speed in real time.

In another aspect, the application provides a firearm reticle system operationally configured to provide target acquisition according to the distance of the target from the firearm and/or the size of the target. In one embodiment the size of the target may include the height of the target. In another embodiment the size of the target may include the width of the target. In another embodiment the size of the target may include both the height and width of the target at any given moment.

In another aspect, the application provides a firearm reticle system operationally configured set for a target speed of potentially moving target of a known height and/or width at a given distance from the firearm.

In another aspect, the application provides a reticle system whereby the firearm user may employ one or more target acquisition features as desired.

In another aspect, the application provides a reticle system whereby the firearm user may employ one or more target acquisition features without the need to make any calculations prior to firing upon the target.

In another aspect, the application provides a reticle system whereby the firearm user may employ one or more target acquisition including bullet drop compensation.

In another aspect, the application provides a method of ranging a desired target by employing a primary reticle displaying bullet trajectory over known distances from the firearm including target width indicators at known distances. A secondary range indicator may be employed as desired to promote optimum target acquisition when a target's width is unattainable or otherwise obstructed.

In another aspect, the application provides a firearm reticle system including a central aiming member operationally configured for initial target acquisition by ranging the head and/or torso of a human shaped target simultaneously at a given distance or range from the firearm employing the reticle system.

In another aspect, the application provides a firearm reticle system including a primary reticle including a scale for determining the distance of a target from the firearm according to the center mass of a target.

In another aspect, the application provides a firearm reticle system employing bullet drop compensation over a plurality of distances, wind compensation according to a particular wind velocity over a plurality of distances and moving target leads for targets traveling at a predetermined velocity.

In another aspect, the application provides a method allowing for faster (or decreased) time on target action down to about 4.0 seconds by providing a reticle system operationally configured with pre-calculated parameters related to a predetermined wind speed, target speed when in motion, bullet drop compensation, ranging information, and combinations thereof.

In another aspect, the application provides a method for extending the range of a particular weapon system by providing a reticle system operationally configured with pre-calculated parameters regarding wind speed, the speed of a target in motion, bullet drop compensation, ranging information, and combinations thereof.

Discussion

With reference now to the drawings, one simplified illustration of an embodiment of a firearm reticle system is provided in FIG. 1. As shown within the demonstrative sight picture 5, the reticle system 10 suitably includes a first reticle or reticle member defined by indicators such as a central aiming member 12, a zero point dot 14 centrally located within the central aiming member 12, a vertical crosshair 16 and at least one horizontal crosshair 18 intersecting the vertical crosshair 16, the reticle being operationally configured to correlate bullet drop compensation with horizontal range estimation for a particular target. As described in detail below, the intersection 19 of the various crosshairs are impact locations of shots fired at various distances, unless there is wind, whereby the reticle system 10 may also include one or more wind adjustment members represented here as wind adjustment as dots 20 on either side of each horizontal crosshair 18 to allow for aiming adjustments in windy conditions. In addition, the reticle system 10 may include one or more leads 22 or "lead dots" on either side of the central aiming member 12 as desired, the leads 22 being in substantially linear alignment with the zero point dot 14 as shown and spaced relative to correlate to a predetermined speed of a moving target.

Figure 2:
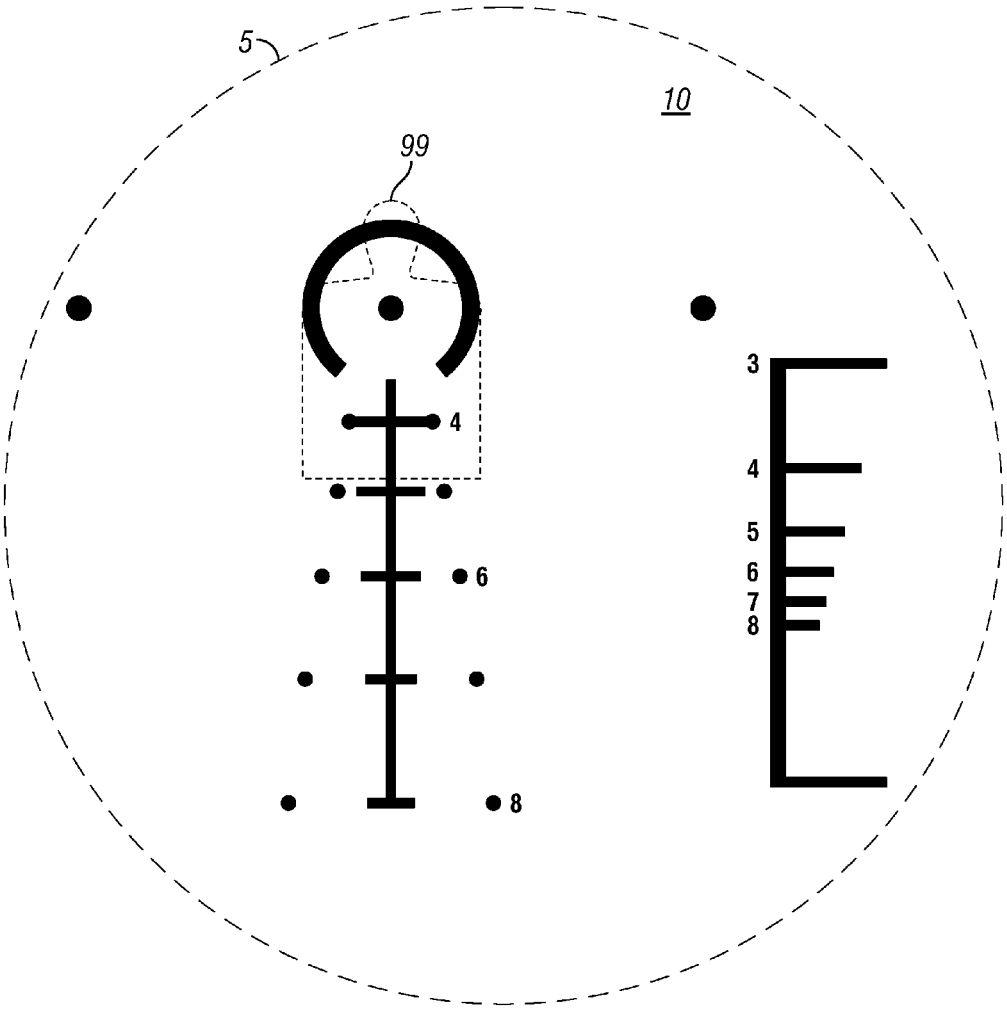
FIG. 2 is another plan view of the reticle system of FIG. 1.

As illustrated, the central aiming member 12 includes a ring like member that is open ended (a "first opening 13A") directionally toward the vertical crosshair 16, wherein the first opening 13A has a particular width according to desired target parameters, i.e., the bottommost portion of the central aiming member 12 is empty. For example, the first opening 13A may be set to correlate to a size requirement of a one or more particular targets at a given distance from the firearm (and reticle system used there with). Without limiting the invention, the central aiming member 12 may be provided in other forms or shapes as desired. For example, the central aiming member 12 may have a particular shape operationally configured to equip the reticle system 10 for aiming at a particular type of target, including animate and inanimate objects of various shapes and sizes. As shown in FIG. 2, the reticle system of FIG. 1 may be operationally configured for aiming a firearm at an enemy combatant 99 wherein the width of the first opening is operationally configured for assisting the reticle system 10 user with targeting the central mass of an enemy combatant 99 at a predetermined distance from the firearm.

Referring again to FIG. 1, the reticle system 10 also includes a second ranging scale adjacent the first reticle member. The second ranging scale suitably includes at least a baseline 28, a vertical ranging line 30 extending from the baseline 28 and one or more target size indicators 32 extending out from the vertical ranging line 30 in substantially parallel alignment with the baseline 28. The baseline 28 may include any length desired for effective operation of the reticle system 10 and each of the target size indicators 32 employed has a length different from the remaining target size indicators 32. As such, the longest target size indicator may include a length less than, equal to, or greater than the baseline 28 as desired. In a particularly advantageous embodiment, the target size indicators 32 are operationally configured to assist an individual using the reticle system 10 in ranging an enemy combatant 99 horizontally and vertically according to the height and/or the width of an enemy combatant 99, as discussed further below.

In another simplified embodiment, the reticle system 10 may include a central aiming member 12 having a second opening 13B opposite the first opening (see FIG. 3) whereby the uppermost portion of the central aiming member 12 is empty. In this embodiment, the width of the second opening 13B may be set to correlate to a size of the head 99H of an enemy combatant 99 at a known distance from the firearm (see FIG. 4). The second opening 13B may also be effective for aiming purposes in a situation where only the head of an enemy combatant 99 is in clear view. Additionally, the second opening 13B and central aiming member 12 provide enhanced contouring of the head and torso of an enemy combatant 99 for faster aiming purposes, i.e., faster time on target. Further discussion of the operation of the present reticle system 10 will be discussed in terms of the embodiment depicted in FIG. 3.

Operation of the reticle system 10 is suitably determined according to the set spacing and sizes of the individual components described above relative to each other. Depending on the characteristics of a particular firearm utilizing the reticle system 10, the reticle system 10 may be set to range a target at one or more particular distances as desired. Likewise, the present reticle system 10 employs basic perspective principles known in the field of ranging reticles. In particular, an object appears smaller to a viewer the further the object is from the firearm employing the reticle system 10.

Figure 5:
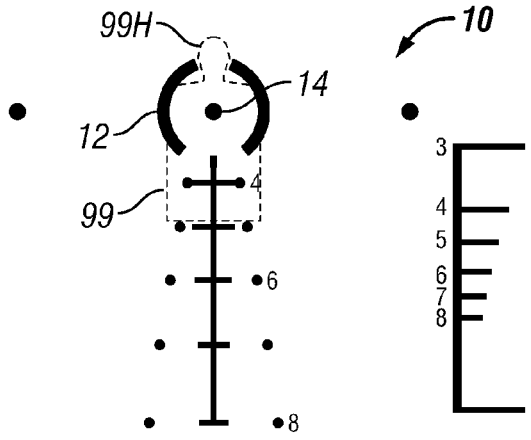
FIG. 5 is an embodiment of a reticle system including a target located at a first distance from the firearm making use of the reticle system.

With attention to the simplified illustration of FIG. 5, one embodiment of the reticle system 10 may include a central aiming member 12 for initial target acquisition, i.e., ranging of an enemy combatant 99, at a distance of about 182.9 meters (about 200 yards) based on a predetermined average center mass and height of an enemy combatant 99. For purposes of illustration, the average center mass will be discussed in terms of about 0.46 m (about 18.0 inches) and the height will be discussed in terms of about 1.79 m (about 70.0 inches). As such, the width (or inner diameter) of the central aiming member 12 corresponds to a width of about 0.46 meters (about 18.0 inches) for an enemy combatant 99 that is located about 182.9 meters (about 200.0 yards) away from the firearm—the enemy combatant 99 fitting within the central aiming member 12 as shown in FIG. 5—including the head 99H fitting within the second opening 13B. At this distance, suitable aiming of the enemy combatant 99 is accomplished using the bottom half of the zero point dot 14, which targets the central mass of the enemy combatant's torso region.

For firearm distance shooting (as employed by competition shooters, law enforcement officers and military snipers), it is important to consider the drop of a bullet over distance. As understood by the skilled artisan, the amount of bullet drop may be determined according to one or more factors including, but not necessarily limited to bullet caliber, barrel length, rifling, bullet weight, charge of ammunition, and combinations thereof. Such factors are often referred by skilled artisans as a "package" and are substantially uniform over time for a particular firearm. Thus, as a target lies further away from the firearm (and the reticle system 10), the reticle system 10, including the various components, e.g., the vertical and horizontal crosshairs 16, 18, may be oriented and sized for ranging an enemy combatant 99 based on a given package.

Figure 4:
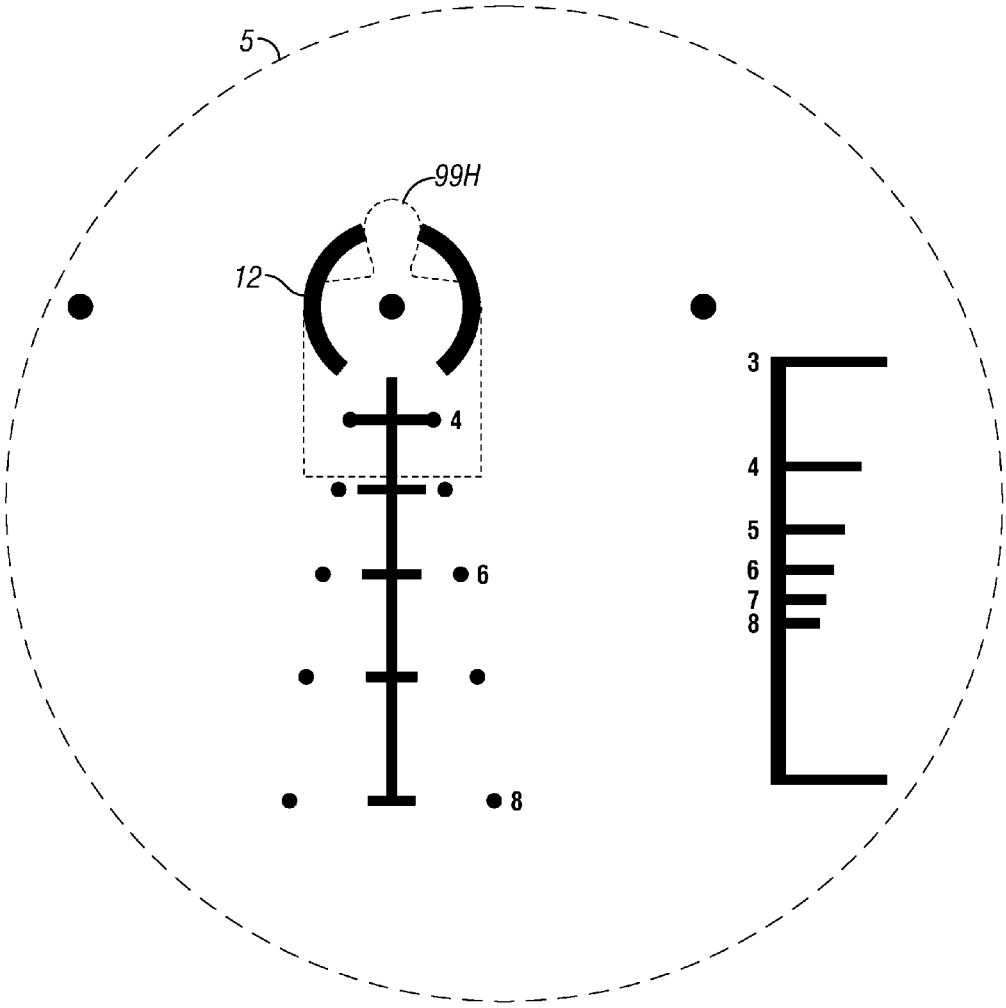
FIG. 4 is another plan view of the reticle system of FIG. 3.
Figure 6:
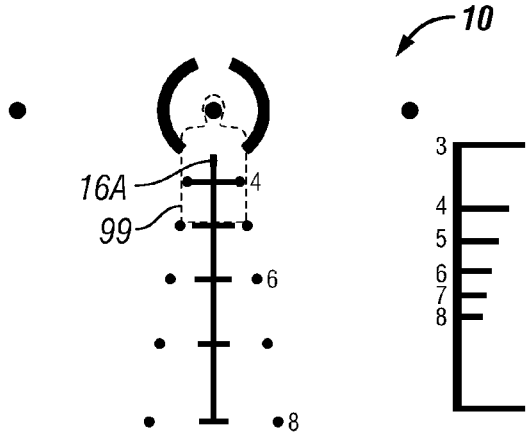
FIG. 6 is another view of the reticle system of FIG. 5 including a target located at a second distance from the firearm making use of the reticle system.
Figure 7:
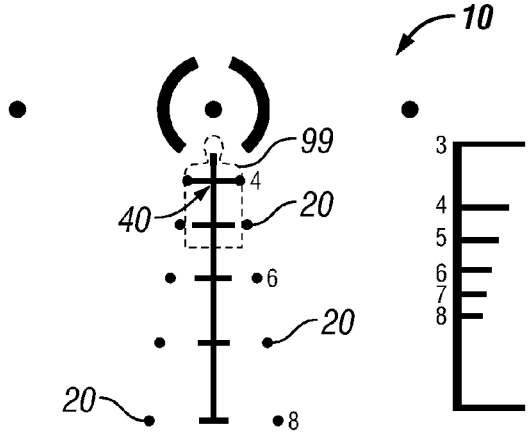
FIG. 7 is another view of the reticle system of FIG. 5 including a target located at a third distance from the firearm making use of the reticle system.

When a shooter is initially aiming at an enemy combatant 99, he/she may site the enemy combatant within the central aiming member 12 as shown in FIGS. 2 and 4. If the enemy combatant 99 is observed to be smaller than the central aiming member 12 then the shooter may adjust the reticle system 10 visually relocating the enemy combatant 99 along the vertical crosshair 16 until the width of enemy combatant 99 is substantially equal to the width of a particular horizontal crosshair, which ranges and aims the enemy combatant according to the bullet drop compensation provided by the crosshairs 16, 18. As depicted in FIG. 6, at a distance of about 274.3 meters (about 300.0 yards) the average center mass of an enemy combatant 99 is ranged according to the first opening 13A of the central aiming member 12 whereby aiming of the enemy combatant 99 is accomplished using the upper end 16A of the vertical crosshair 16. Turning to FIG. 7, at a distance of about 365.8 meters (about 400.0 yards) the average center mass of an enemy combatant 99 is ranged and aimed according to the width and intersection 40 of the first horizontal crosshair. In other words, if the average center mass of an enemy combatant 99 substantially equals the width of the first horizontal crosshair, this communicates to the user of the reticle system 10 that the enemy combatant is about 365.8 meters (about 400.0 yards) away from the user's firearm.

Figure 8:
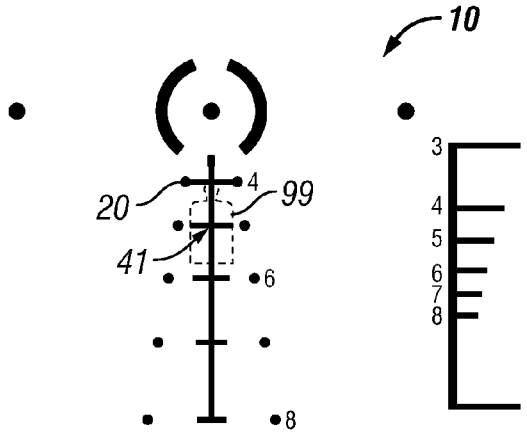
FIG. 8 is another view of the reticle system of FIG. 5 including a target located at a fourth distance from the firearm making use of the reticle system.
Figure 9:
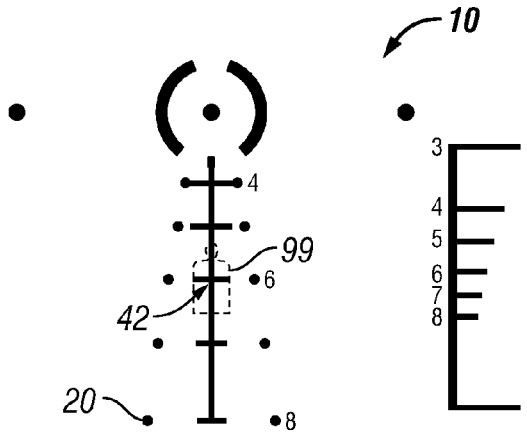
FIG. 9 is another view of the reticle system of FIG. 5 including a target located at a fifth distance from the firearm making use of the reticle system.
Figure 10:
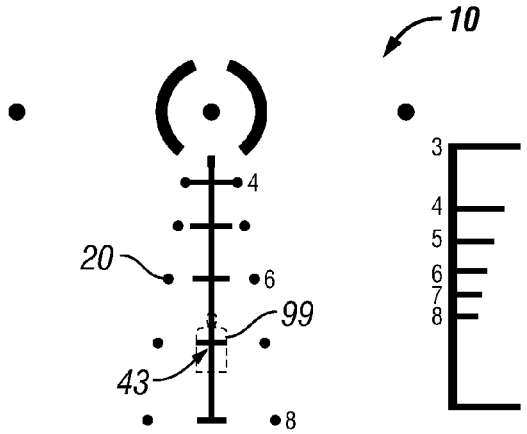
FIG. 10 is another view of the reticle system of FIG. 5 including a target located at a sixth distance from the firearm making use of the reticle system.
Figure 11:
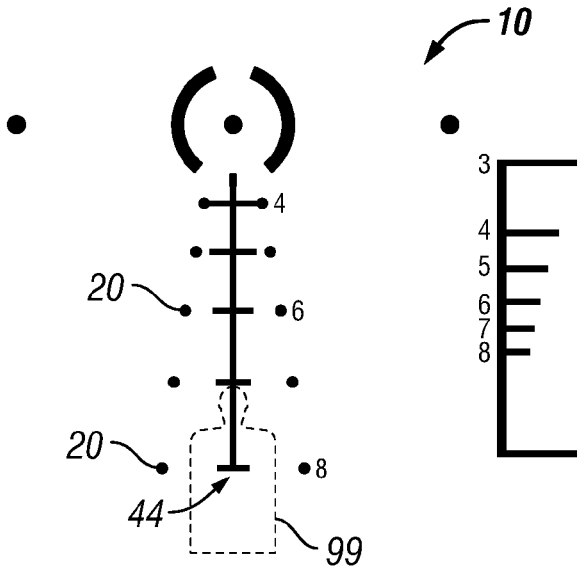
FIG. 11 is another view of the reticle system of FIG. 5 including a target located at a seventh distance from the firearm making use of the reticle system.

Turning to FIG. 8, at a distance of about 457.2 meters (about 500.0 yards) the average center mass of an enemy combatant 99 is ranged and aimed according to the width and intersection 41 of the second horizontal crosshair. At a distance of about 548.6 meters (about 600.0 yards) the average center mass of an enemy combatant 99 is ranged and aimed according to the width and intersection 42 of the third horizontal crosshair as shown in FIG. 9. At a distance of about 640.1 meters (about 700.0 yards) the average center mass of an enemy combatant is ranged and aimed according to the width and intersection 43 of the fourth horizontal crosshair as shown in FIG. 10. In this embodiment, the furthest distance ranged is about 731.5 meters (about 800.0 yards), wherein the average center mass of an enemy combatant 99 is ranged and aimed according to the width and intersection 44 of the fifth horizontal crosshair as shown in FIG. 11. In this simplified embodiment of the reticle system 10 abbreviated yardage distance indicators have been included using the numbers 4, 6 and 8 adjacent the first, third and fifth horizontal crosshairs, the indicators corresponding to 400, 600 and 800 yards respectively. It is contemplated herein that the average center of mass, the distance settings, wind adjustment dots 20 and leads 22 of the reticle system 10 may be changed or otherwise reconfigured as desired. Particularly where the size and/or shape and/or speed of a particular target is different from the simplified illustration provided in the drawings.

Figure 3:
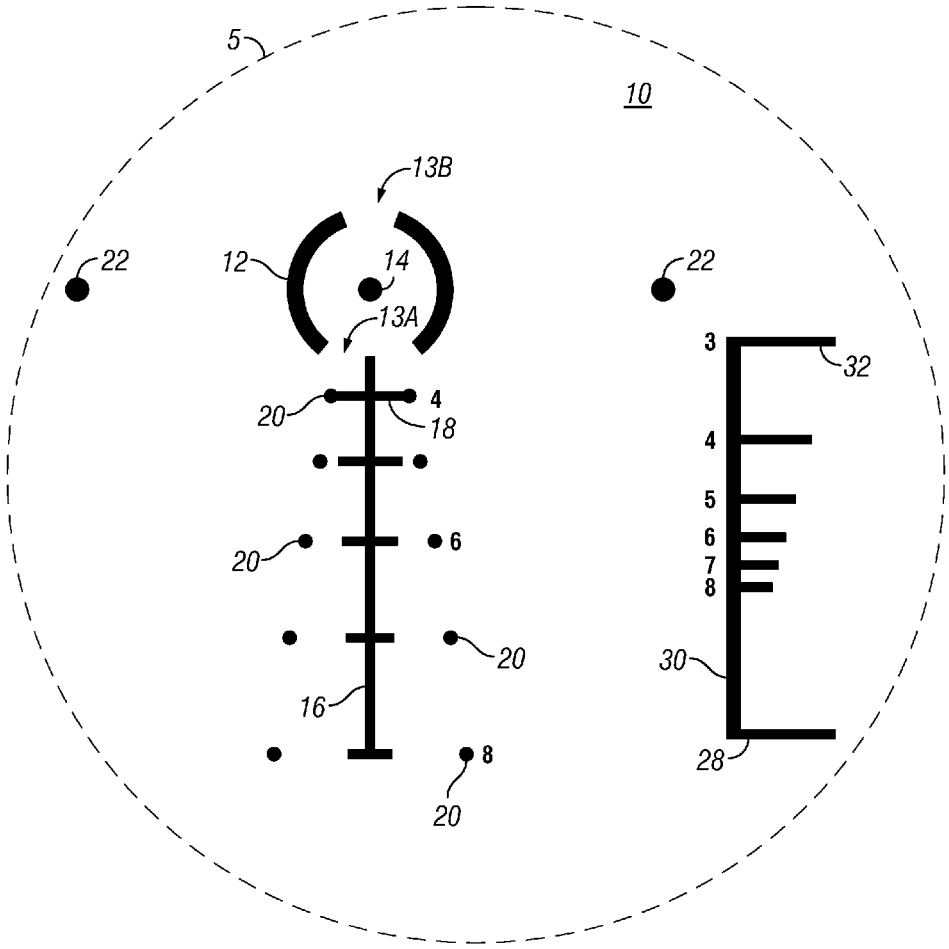
FIG. 3 is a plan view of another embodiment of the reticle system of the present application.

It is also contemplated that additional horizontal crosshairs indicative of other distances may be included in the first reticle member for ranging purposes as desired. In addition, because wind may offset the desired path of a bullet, the reticle systems 10 depicted in FIGS. 1 and 3 may include wind adjustment dots 20 corresponding to the horizontal crosshairs 18 as shown. In the embodiments of FIGS. 1 and 3, the wind adjustment dots 20 are set in horizontal alignment with the distal ends of the horizontal crosshairs 18 at a distance from the vertical crosshair 16 to compensate for an average wind speed of about 2.24 mps (about 5.0 mph). As shown, the wind adjustment dots 20 are located increasingly further from the intersections 40-44 the further an enemy combatant 99 is located from the firearm and reticle system 10 used there with.

Figure 12:
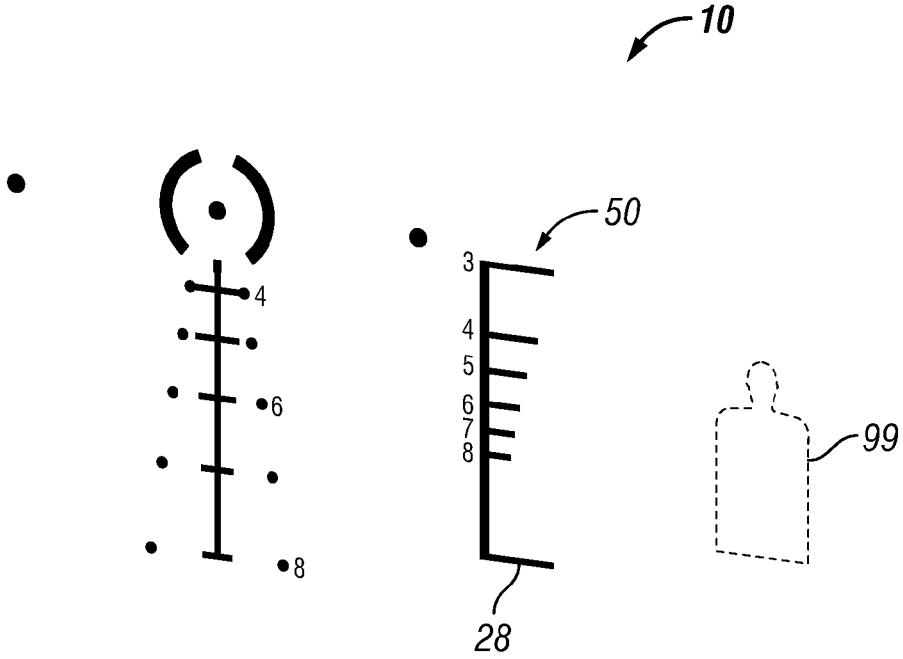
FIG. 12 is another view of the reticle system of FIG. 3.

With attention to FIG. 12, the second ranging scale 50 may be utilized when an enemy combatant 99 is not directly facing the firearm/reticle system 10 or in instances where the lower limbs or torso of an enemy combatant 99 are not within view or clear sight. In the embodiments of FIGS. 1 and 3 the second ranging scale 50 is suitably operationally configured (1) to range an enemy combatant 99 having a height of about 1.79 m (about 70.0 inches)—an individual that is commonly referred to in the United States of America as being five feet ten inches tall—and/or (2) to range an enemy combatant having an average center mass of about 0.46 m (about 18.0 inches), e.g., where an enemy combatant 99 is lying on the ground firing a weapon at the user of the reticle system 10, in which case the user can range the enemy combatant according to the breadth of the enemy combatant's shoulders. Thus, the second ranging scale 50 may be operationally configured to range an enemy combatant 99 of a particular height or width according to the target size indicators 32 provided. Likewise, the second ranging scale 50 provides for real time target acquisition of an enemy combatant 99 that moves from a standing type position to a drop down type position when being targeted by a user of the reticle system 10.

Figure 13:
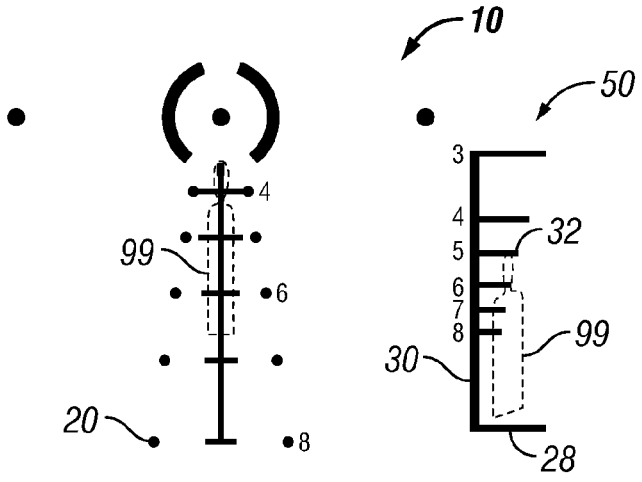
FIG. 13 is another view of the reticle system of FIG. 3 including a target about 457.2 meters (about 500.0 yards) from the firearm and reticle system attached thereto.

As exemplified in FIG. 13, if an enemy combatant 99 is standing sideways (or otherwise not facing the firearm user directly), the user can place the bottom of the enemy combatant 99, e.g., the feet, at the baseline 28 of the second ranging scale 50 and determine the distance of the enemy combatant 99 according to the location of the top of the enemy combatant 99, e.g., the head, in relation to the target size indicators 32. As the simplified illustration of FIG. 13 shows, the top of the enemy combatant 99 reaches the target size indicator 32 labeled number "5" (see "5" at the left side of the vertical ranging line 30), which corresponds to a distance of an enemy combatant 99 at about 457.2 meters (about 500.0 yards) from the firearm. As further depicted in FIG. 13, once the distance of the enemy combatant 99 is determined, the sideways standing enemy combatant 99 can be aligned along the first reticle member at the intersection of the crosshairs corresponding to about 457.2 meters (about 500.0 yards) from the firearm. Also, if an enemy combatant 99 standing upright is originally ranged using the second ranging scale 50 and suddenly drops down or otherwise lowers his/her torso, the shooter can adjust the second ranging scale 50 by moving the enemy combatant 99 in alignment with the proper target size indicator 32 to determine the enemy combatant's distance from the shooter. For example, if a shooter can only see the head of an enemy combatant 99, the shooter can align the combatant's head with the target size indicator 32 that is about twice the width of the combatant's head for ranging purposes. Once the shooter has acquired the approximate range of the enemy combatant 99, the shooter can reposition the enemy combatant 99 within the first reticle member 25 at the range determined via the second ranging scale 50.

Figure 14:
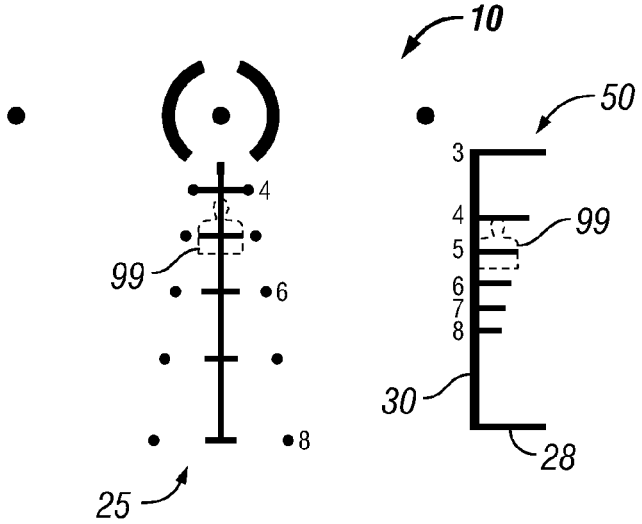
FIG. 14 is another view of the reticle system of FIG. 3 including a target about 457.2 meters (about 500.0 yards) from the firearm and reticle system attached thereto.
Figure 15:
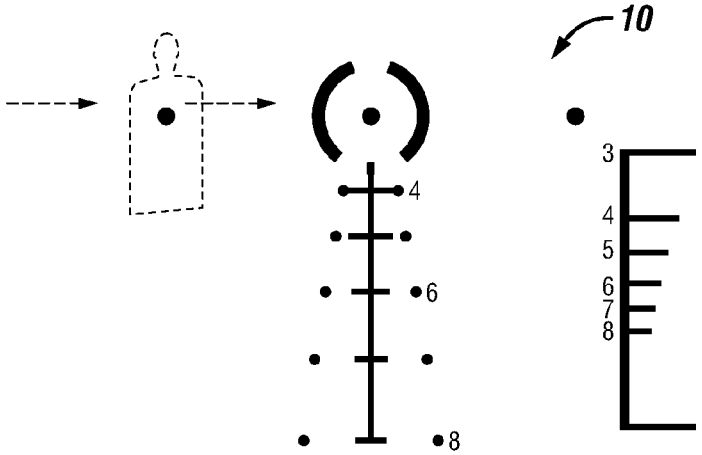
FIG. 15 is another view of the reticle system of FIG. 3 illustrating general operation of a lead dot of the reticle system.

As shown in the simplified embodiment of FIG. 14, where an enemy combatant 99 is facing the firearm user, but is only partially visible, the second ranging scale 50 may be employed to range the enemy combatant 99 by using the target size indicators 32 as width indicators. In the embodiment of FIG. 14, the width of the enemy combatant 99 is about equal to the target size indicator corresponding to about 457.2 meters (about 500.0 yards) from the firearm. As further depicted in FIG. 14, once the distance of the enemy combatant 99 is determined, the enemy combatant 99 can be aligned along the first reticle member 25 at the intersection of the crosshairs corresponding to about 457.2 meters (about 500.0 yards) from the firearm.

In a situation where an enemy combatant 99 is traveling left to right or right to left, the one or more leads 22 may be employed to assist with maximizing aiming capabilities of the reticle system 10 with regard to a moving target. Although the one or more leads 22 may be set for any particular speed or range of speeds, the leads 22 of the reticle systems depicted in FIGS. 1 and 3 are spaced to correlate to an average target speed of about 13.8 km/h (about 8.6 mph) at a range of about 91.4 meters to about 274.3 meters (about 100 to about 300 yards). It is also contemplated that additional leads 22 may be employed that correspond to other target speeds.

The invention will be better understood with reference to the following non-limiting examples, which are illustrative only and not intended to limit the present invention to a particular embodiment.

EXAMPLE 1

Figure 16:
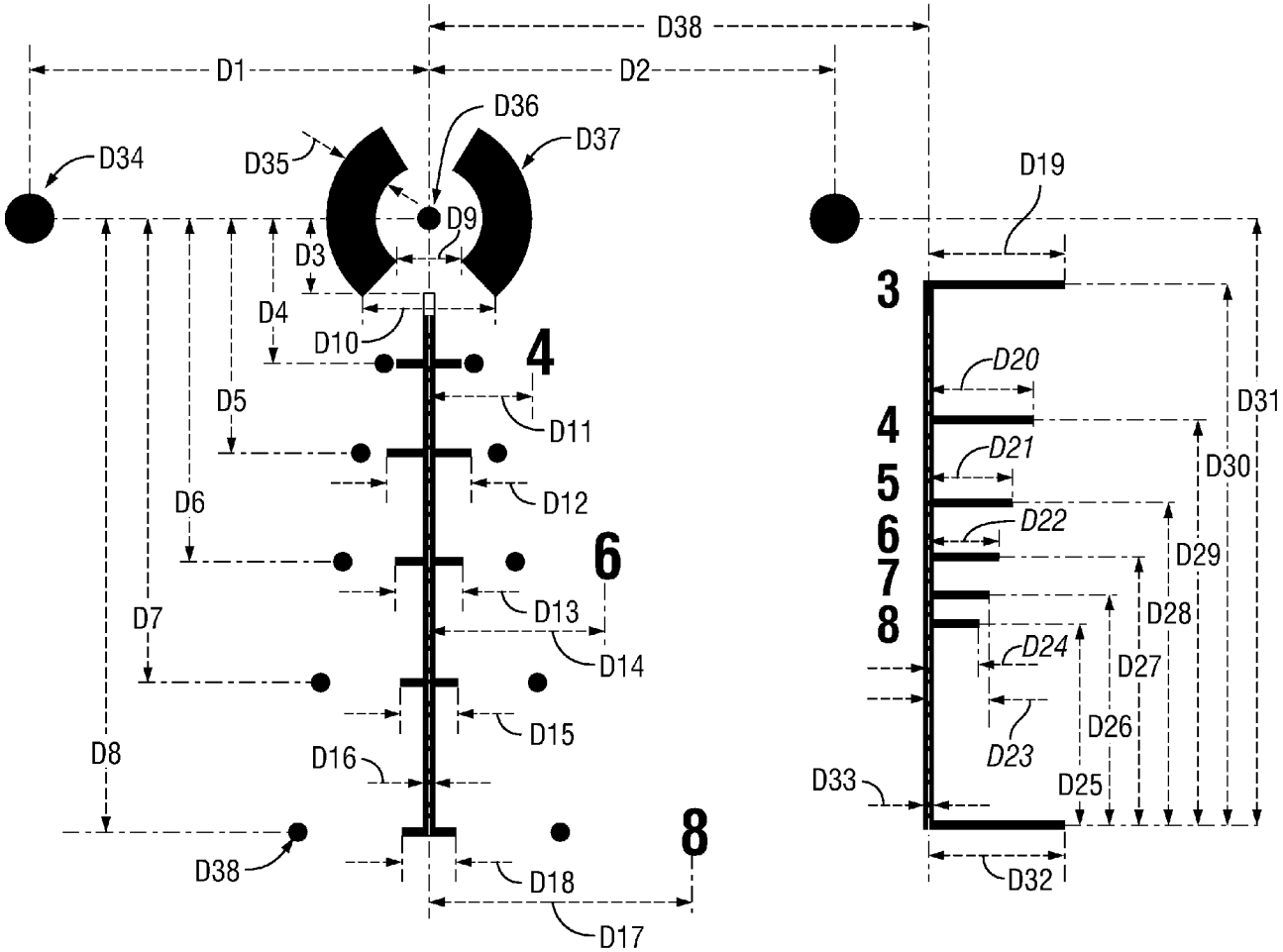
FIG. 16 is another view of the reticle system of FIG. 3.

In a first non-limiting example, a reticle system 10 as illustrated in FIG. 16 is provided having the following spacing and sizes:

| | |
|---|---|
| D1 | about 16.60 Minutes of Angle ("MOA") |
| D2 | about 16.60 MOA |
| D3 | about 3.020 MOA |
| D4 | about 5.985 MOA |
| D5 | about 9.650 MOA |
| D6 | about 14.150 MOA |
| D7 | about 19.125 MOA |
| D8 | about 25.310 MOA |
| D9 | about 3.06 MOA |
| D10 | about 5.730 MOA |
| D11 | about 4.200 MOA |
| D12 | about 3.438 MOA |
| D13 | about 7.200 MOA |
| D14 | about 2.865 MOA |
| D15 | about 2.455 MOA |
| D16 | about 0.30 MOA |
| D17 | about 10.800 MOA |
| D18 | about 2.148 MOA |
| D19 | about 5.730 MOA |
| D20 | about 4.298 MOA |
| D21 | about 3.438 MOA |
| D22 | about 2.865 MOA |
| D23 | about 2.455 MOA |
| D24 | about 2.148 MOA |
| D25 | about 8.350 MOA |
| D26 | about 9.550 MOA |
| D27 | about 11.140 MOA |
| D28 | about 13.370 MOA |
| D29 | about 16.711 MOA |
| D30 | about 22.280 MOA |
| D31 | about 25.130 MOA |
| D32 | about 5.730 MOA |
| D33 | about 0.60 MOA |
| D34 | about 2.00 MOA |
| D35 | about 2.00 MOA |
| D36 | about 1.00 MOA (diameter) |
| D37 | about 8.600 MOA (diameter) |
| D38 | about 20.50 MOA |

EXAMPLE 2

In a second non-limiting example, a weapon system including a 5.56 mm, magazine-fed, air cooled, semi-automatic rifle operationally configured for accurate non-optic use out to a distance of about 274.3 meters (about 300.0 yards) is provided. A reticle system 10 as illustrated in FIG. 3 is provided for use with weapon system whereby the reticle system 10 is operationally configured to extend the accuracy of the rifle out to about 731.5 meters (about 800.0 yards).

EXAMPLE 3

In a third non-limiting example, a weapon system including a 5.56 mm, magazine-fed, air cooled, semi-automatic rifle is provided with a military mil-dot reticle as understood by persons of ordinary skill in the art of firearm optics and sights. Desired target acquisition requires one or more calculations resulting in a time on target of about one minute or more. The military mil-dot reticle is replaced with a reticle system 10 as illustrated in FIG. 3. The time on target is decreased at least in half because the reticle system 10 is calculation free whereby one or more of the bullet drop compensation information, wind compensation information, target travel speed lead information and ranging information are pre-set for real time target acquisition by a user of the weapon system.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A firearm reticle system comprising:

a reticle operationally configured to correlate one or more of bullet drop compensation, horizontal range estimation, wind information, and target travel speed lead information for a target; and a scale operationally configured to horizontally range the average center mass of the target and vertically range the height of the target at one or more predetermined distances from the reticle system;

wherein the reticle includes a ring like central aiming member wherein the uppermost portion of the central aiming member is empty, the reticle being operationally configured for target acquisition of the average center mass of the target at one or more predetermined distances from the reticle system.

2. The firearm reticle system of claim 1 wherein the range of the scale corresponds to the range of the reticle.

3. The firearm reticle system of claim 1 wherein the reticle is operationally configured to correlate bullet drop compensation with range estimation according to a predetermined average center mass of a target.

4. The firearm reticle system of claim 1 wherein the reticle includes one or more wind adjustment members.

5. The firearm reticle system of claim 1 wherein the reticle includes one or more leads operationally configured to compensate for a target moving at a particular average speed.

6. The firearm reticle system of claim 1 wherein the central aiming member may include a particular shape operationally configured to equip the reticle system for aiming at a particular type of target.

7. The firearm reticle system of claim 1 wherein the central aiming member is operationally configured to range the head and torso of a human shaped target.

8. A firearm reticle system for acquisition of a target, the firearm reticle system having one or more pre-set parameters selected from the group consisting of bullet drop compensation information, wind information, target travel speed lead information, ranging information, and combinations thereof according to a particular package, the reticle system including a reticle having a ring like central aiming member wherein the uppermost and bottommost portions of the central aiming member are empty and a scale operationally configured to horizontally range the average center mass of the target and vertically range the height of the target at one or more predetermined distances from the reticle system.

9. The firearm reticle system of claim 8 wherein one or more of the pre-set parameters are operationally configured to extend the accurate range of a weapon system by at least 100 percent beyond the weapon system's non-optic capacity.

10. A calculation free method of decreasing time on target for a user of a firearm comprising:

providing a firearm reticle system for use with a firearm of a particular package, the firearm reticle system having pre-set parameters selected from the group consisting of bullet drop compensation information, wind information, target travel speed lead information, ranging information, and combinations thereof, wherein the firearm reticle system includes (1) a reticle operationally configured to correlate bullet drop compensation with horizontal range estimation for a target, the reticle having a ring like central aiming member wherein the uppermost portion of the central aiming member is empty and (2) a scale operationally configured to horizontally range the average center mass of the target and vertically range the height of the target at one or more predetermined distances from the reticle system; wherein the reticle includes one or more wind adjustment members and one or more leads operationally configured to compensate for a target moving at a particular average speed.

11. The method of claim 10 wherein the scale includes a baseline, a vertical ranging line extending from the baseline, a plurality of target size indicators extending out from the vertical ranging line in substantially parallel alignment with the baseline, each of the target size indicators having a different length from the remaining target size indicators.

12. The method of claim 10 whereby the reticle includes a central aiming member for initial target acquisition at a distance of about 182.9 meters (about 200 yards) according to an average center mass for a target of about 0.46 m (about 18.0 inches).

13. The method of claim 10 whereby the central aiming member includes a zero point dot centrally located within the central aiming member.

14. The method of claim 10 wherein the uppermost portion of the central aiming member is operationally configured to range a head portion of a human shaped target.

15. The method of claim 10 whereby the reticle is operationally configured to compensate for a target moving at an average speed of about 13.8 km/h (about 8.6 mph).

16. The method of claim 10 whereby the reticle is operationally configured to compensate for an average wind speed of about 2.24 mps (about 5.0 mph) from about 274.3 meters to about 731.5 meters (about 300.0 yards to about 800 yards).

17. The method of claim 11 wherein the reticle includes a ring like central aiming member wherein the uppermost and bottommost portions of the central aiming member are empty.

18. The firearm reticle system of claim 5 further including a zero point dot centrally located within the central aiming member, the zero point dot being in substantially linear alignment with the one or more leads.

* * * * *